US005759139A

United States Patent [19]

Wright

[11] Patent Number: 5,759,139

[45] Date of Patent: Jun. 2, 1998

[54] LUNGE POLES

[75] Inventor: Donald R. Wright, Akron, Ohio

[73] Assignee: Fitness Quest, Inc., Canton, Ohio

[21] Appl. No.: 779,985

[22] Filed: Dec. 23, 1996

[51] Int. Cl.[6] ..... A63B 21/02

[52] U.S. Cl. ..... 482/128; 482/121; 482/123; 482/129

[58] Field of Search ..... 482/128, 121, 482/123, 126, 129, 71, 117

[56] References Cited

U.S. PATENT DOCUMENTS

| | | | |
|---|---|---|---|
| 1,535,391 | 4/1925 | Anderson . | |
| 2,253,012 | 2/1941 | Benner et al. | 482/71 |
| 3,782,721 | 1/1974 | Passera . | |
| 3,807,727 | 4/1974 | Ferguson | 482/71 |
| 4,249,727 | 2/1981 | Dehan . | |
| 4,953,858 | 9/1990 | Zelli | 482/71 |
| 5,013,034 | 5/1991 | March et al. . | |
| 5,330,407 | 7/1994 | Skinner | 482/117 |

FOREIGN PATENT DOCUMENTS

| | | |
|---|---|---|
| 1108659 | 2/1956 | France . |
| 2147212 | 5/1985 | United Kingdom . |

OTHER PUBLICATIONS

Take The Lunge, VIE Fitness Magzine, Dec. 1995.

*Primary Examiner*—Lynne A. Reichard
*Attorney, Agent, or Firm*—Sand & Sebolt

[57] ABSTRACT

Lunge poles used to assist a user in maintaining his or her balance while performing lunges include a base, a pair of resilient couplings mounted on the base and a pair of tubular poles extending from the resilient couplings. The base is generally planar and includes four outwardly extending feet having rubber pads on the bottom thereof to frictionally retain the base in position on a floor. A pair of holes is formed in the top of the base for receiving the resilient couplings. An annular groove is formed in the couplings for snap-fitting the couplings with the holes of the base. The couplings include an elongated tapered stem which extends downwardly into the base and a criss-crossed shaped top portion for receiving a bottom end of the tubular poles. A middle section of the couplings is tapered downwardly forming a thin neck which allows the couplings to pivot on the base in a 360° range of motion. A large circular flange is formed on the couplings to prevent the resilient couplings from being pushed through the holes of the base. Each pole includes an upper section which engages a lower section. A foam handle is disposed around a top end of the upper section of each pole. The poles pivot with the user while the user is performing lunges. The lunges provide a cardiovascular workout while working the user's lower body and the pivotal movement of the poles provide an upper body workout. A resilient band is removably attachable between each pole to selectively increase the resistance therebetween, allowing the user to increase the intensity of the upper body workout.

23 Claims, 3 Drawing Sheets

LUNGE POLES

BACKGROUND OF THE INVENTION

Technical Field

Generally the invention relates to an exercise device. Particularly, the invention relates to a lunge pole exercise device which assists a user in performing lunges. Specifically, the invention relates to lunge poles having a base and two upwardly extending poles pivotally mounted on the base by a pair of flexible elastomeric couplings.

Background Information

In recent years the use of home exercise devices has rapidly increased. Various exercise devices have been developed which allow users to perform exercises in the comfort of their own homes. For example, sit-up machines support a user's head and neck while performing sit-ups, and devices such as cross-country ski machines, treadmills, stair steppers and stationary bike machines allow the user to perform the respective exercises in their homes without the monthly fee of a health spa and without having to travel to and from the spa to exercise or "workout". One problem with some of these devices is that they are expensive and occupy a great deal of space when in use and when in storage. Also, some of these devices do not effectively target a user's hips, buttocks and thighs which are weight gain problem areas for some people.

Further, some of these prior art exercise devices are difficult to use and fail to give the user an adequate cardiovascular workout. Cross country ski machines, for example, require a user to synchronize arm and leg movements in a continuous rhythmic pattern in order to obtain a sufficient workout. If the user breaks the rhythmic pattern the user's heart rate may drop below that needed for an optimum cardiovascular workout, thus requiring the user to restart the exercise routine. Some bike machines have handles which move toward and away from the user when the user rotates the pedals. The user is pulled forward and pushed backwards in an awkward and uncontrollable manner.

Some users prefer simple exercises, such as lunges, which do not require difficult movements and which allow the user to control the difficulty and pace of the workout. Lunges are exercises which allow a user to workout at his or her own pace and obtain a cardiovascular aerobic workout while specifically targeting the user's hips, buttocks and thighs. A user performs lunges by placing one foot forward and squatting downward with one knee extending outwardly at a generally 90° angle and the other knee extending downwardly at a generally 90° angle adjacent to but not touching the floor. The user's upper torso remains in a generally vertical position and moves forward as the user steps forward and bends each knee. The user's body is then raised to the original position with the user's feet shoulder width apart and adjacent one another. The user continues this movement alternating the foot which is placed forward.

Lunges allow the user to control the pace of the workout and specifically target a user's hips, buttocks and thighs. The lunge poles of the present invention assists a user in performing these lunges by providing a pair of pivotally mounted and independently movable poles which help a user maintain his or her balance, and which pivot to work the user's upper body as well as the user's lower body.

Various types of lunge pole exercise devices have been developed which use a pair of lunge poles pivotally mounted to a base. For example, U.K. Pat. No. GB 2147212A discloses an exercise apparatus having a pair of lunge poles pivotally mounted on a base by a ball and socket joint. A pair of handles having a flattened bar is set at an oblique angle to the rod.

French Pat. No. 1,108,649 discloses a base having a right triangle configuration which is placed on the floor against a wall. A pair of lunge poles extend from a front of the base and are pivotally mounted thereto by a ball and socket joint.

U.S. Pat. No. 1,535,391 discloses an exerciser having a base and a single pole pivotally mounted to the base by a ball and socket joint. A compression spring is attached to an adjustment knob which allows the user to increase or decrease the frictional engagement of the ball within the socket joint.

U.S. Pat. No. 3,782,721 discloses a physical training device having a casing and two movable rods mounted to the casing by a pair of ball and socket joints. A pedal or hand grip is mounted to the free end of the rods. The movement of the rods within the ball and socket joints can be restrained by a pair of adjustment mechanisms.

U.S. Pat. No. 4,249,727 discloses a friction type gymnastic apparatus having a base and a bar. One end of the bar is fitted with a sleeve and the other end is connected to the base by a connection mechanism. The connection mechanism includes a usual ball and socket joint.

U.S. Pat. No. 5,013,034 discloses an exercise machine having a rigid base and one or more handles extending from the base, each of which are connected thereto by a friction pivot assembly. Each pivot assembly has two or more non-parallel axes about which the corresponding handle rotates. The pivot assemblies include bearings for providing adjustable frictional resistance to their movement about each axis.

Another known prior art exercise device has a pair of lunge poles mounted on a base by a pair of coil springs. The flexible coil springs allow the poles to pivot in various directions.

Although these prior art exercise devices were adequate for the purpose for which they were intended, the poles of these prior art exercise devices are mounted to the base by either a ball and socket joint or some other type of mechanical pivot assembly which requires multiple parts. These prior art exercise devices fail to disclose a resilient flexible elastomeric coupling which pivotally mounts the poles to the base and which provides a 360° range of movement of the poles relative to the base.

Therefore, the need exists for lunge poles which are pivotally mounted to the base by a pair of resilient elastomeric couplings and which assists a user in maintaining his or her balance while performing lunges. There are no lunge poles of which I am aware which accomplish these results.

SUMMARY OF THE INVENTION

It is an objective of the invention to provide lunge poles which assist a user in maintaining his or her balance while performing lunges.

A further objective is to provide lunge poles which allow a user to exercise his or her hips, thighs and buttocks while simultaneously obtaining a vigorous cardiovascular aerobic workout.

Another objective is to provide lunge poles which allow a user to exercise his or her upper body as well as his or her lower body.

A still further objective is to provide lunge poles which allow the user to increase the resistance between the pivotal movement of the poles relative to one another and which allows the user to obtain a more intense upper body workout.

A further objective is to provide lunge poles which are lightweight, inexpensive and which occupy a relatively small amount of space both when in use and when in storage.

Another objective is to provide lunge poles which are easily assembled and which may be packaged and shipped in a relatively small shipping container.

These objectives and advantages are obtained by the improved lunge poles the general nature of which may be stated as including a base; a first pole pivotally connected to the base; a first flexible elastomeric coupling extending between the first pole and the base; a second pole pivotally connected to the base and independently movable relative to the first pole; and a second flexible elastomeric coupling extending between the second pole and the base.

BRIEF DESCRIPTION OF THE DRAWINGS

The preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
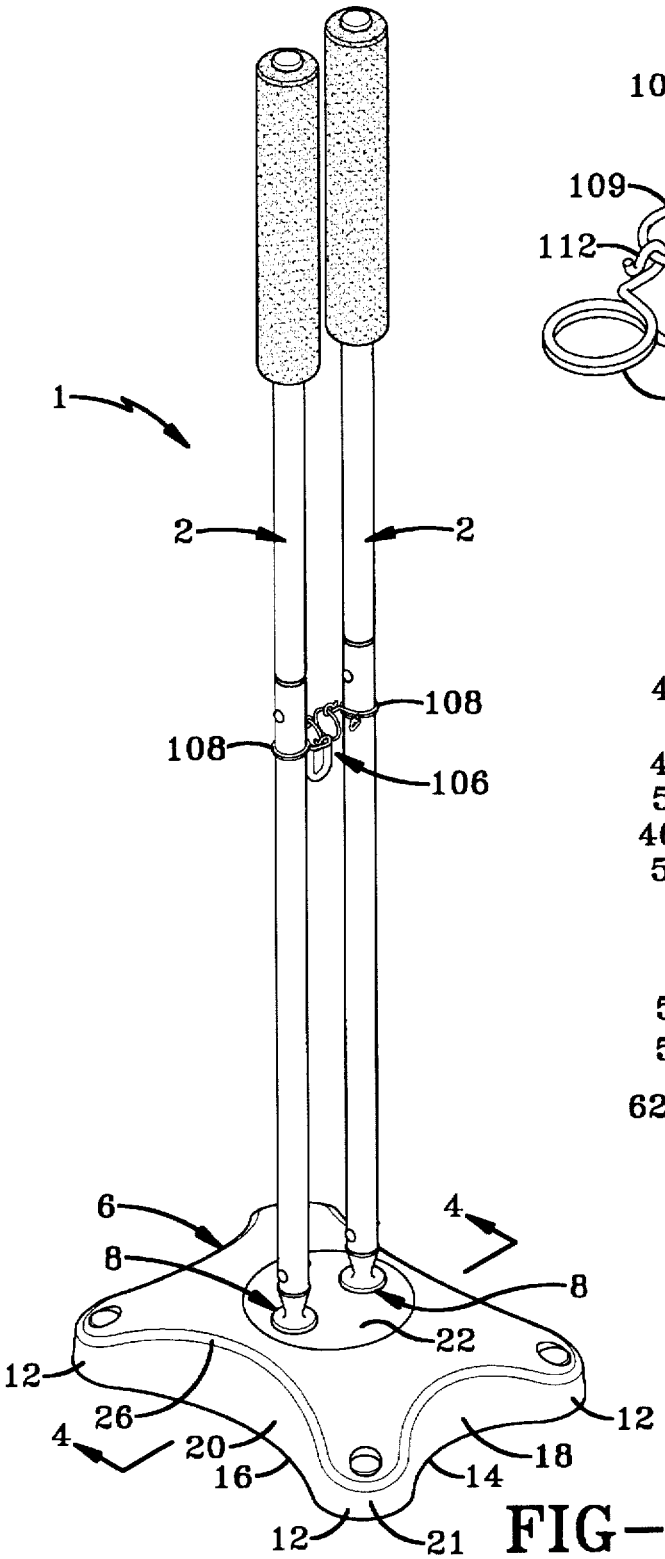
FIG. 1 is a perspective view showing the lunge poles of the present invention.
Figure 3:
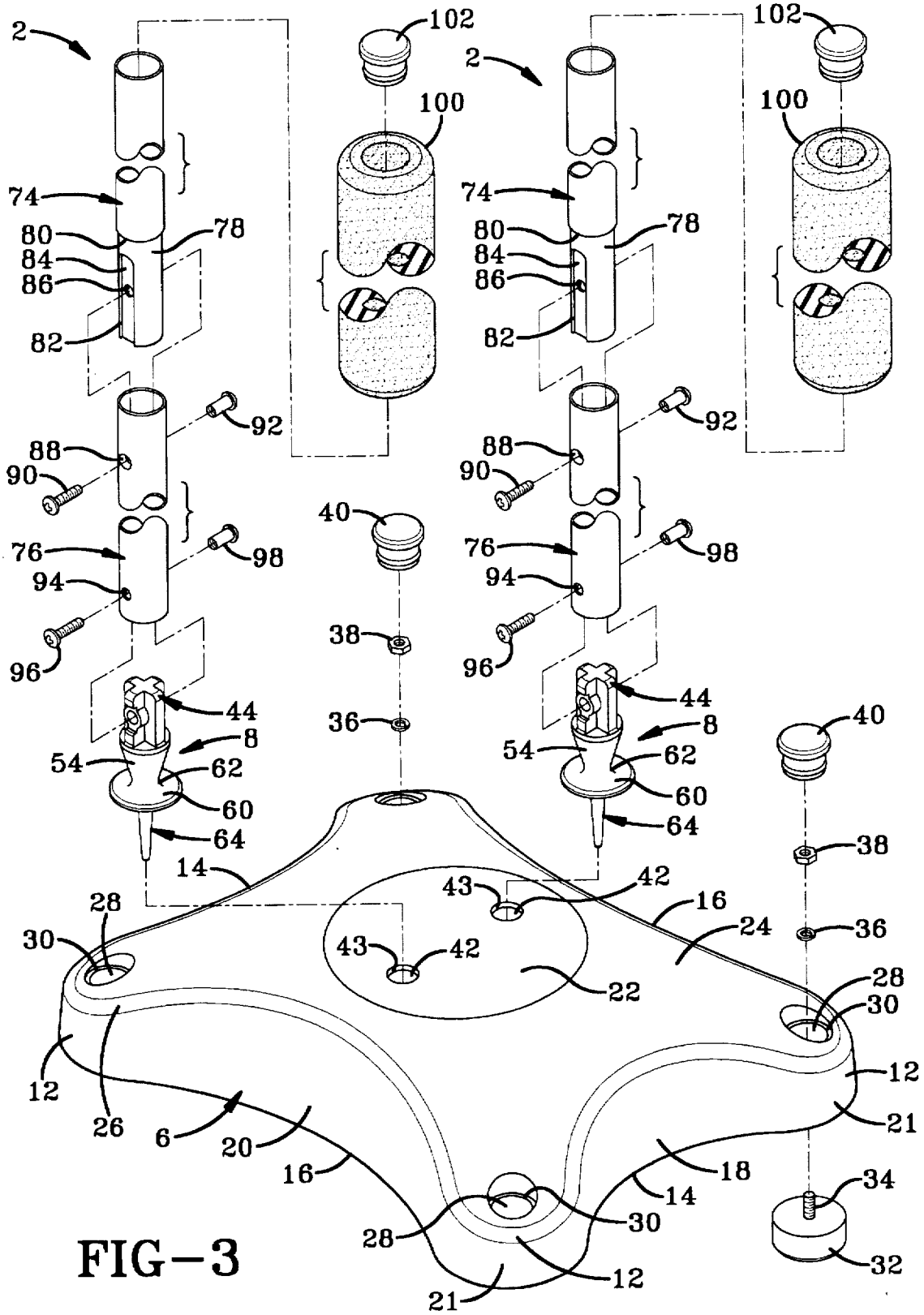
FIG. 3 is an exploded perspective view of the lunge poles of FIG. 1.

The lunge poles of the present invention are shown in FIG. 1 and are indicated generally at 1. Lunge poles 1 include a pair of poles 2 pivotally or universally mounted to a base 6 by a pair of resilient couplings 8. Base 6 is a one-piece member preferably molded of a plastic material. Base 6 is generally butterfly-shaped in plan configuration and has four outwardly extending rounded feet 12 (FIG. 3). Base 6 includes a pair of opposed ends 14 which extend between a pair of opposed sides 16. An inwardly curved end wall 18 extends between feet 12 of each end 14 and an inwardly curved sidewall 20 extends between feet 12 of each side 16. An outwardly curved corner wall 21 extends around each of feet 12 and connects end walls 18 to sidewalls 20. A top surface 24 of base 6 is generally arcuate-shaped between end walls 18 and includes a substantially flat circular area 22 formed centrally thereon. A beveled edge 26 extends around base 6 between top surface 24 and walls 18, 20 and 21. Walls 18, 20 and 21, and top surface 24 form a hollow bottom chamber 27 (FIG. 4) therebetween.

A counterbored hole 28 (FIG. 3) with a stepped shoulder 30 is formed in each of feet 12. A round rubber pad 32 with an upwardly extending threaded stud 34 is attached to a bottom of each of feet 12. Stud 34 extends upwardly through hole 28 and is fastened therein by a usual lock washer 36 and nut 38. A plastic cap 40 snap fits within the top of hole 28 covering the stud, washer and nut assembly to prevent a user of lunge poles 1 from being injured by a sharp edge thereof. Pads 32 frictionally engage a generally flat horizontally extending surface to prevent lunge poles 1 from slipping thereon during use by a user. A hole 42 which is defined by a circular outer edge 43 is formed in flat area 22 adjacent the center of each sidewall 20.

Figure 2:
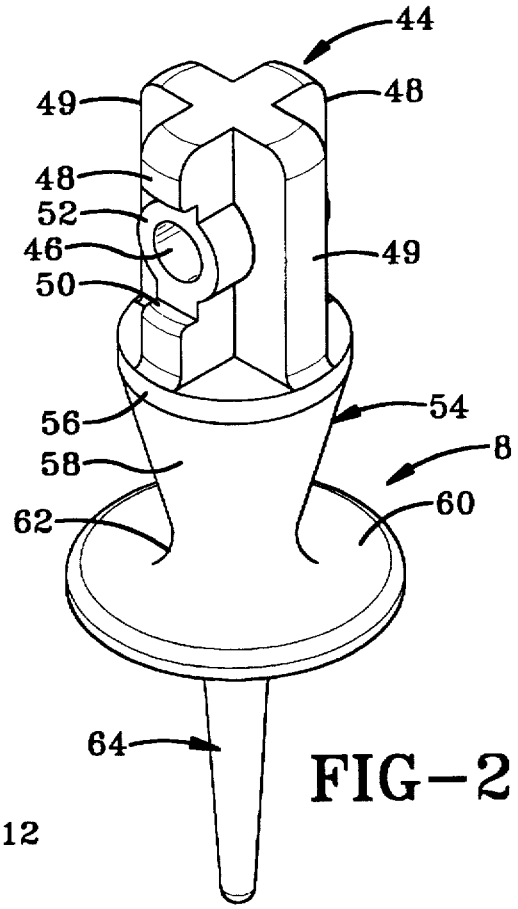
FIG. 2 is an enlarged perspective view of the resilient coupling of the lunge poles of FIG. 1.

In accordance with one of the features of the invention, resilient couplings 8 are preferably formed of a flexible elastomeric material and snap fit within holes 42 as described below. Couplings 8 have a criss-cross-shaped top section 44 (FIG. 2). Top section 44 is formed with one pair of opposed ribs 48 extending perpendicularly to and formed integrally with another pair of opposed ribs 49. A hole 46 is formed laterally through opposed ribs 48. A cut out area 50 is formed in each rib 48 which extends across and slightly above and below hole 46. A boss 52 is formed around hole 46 and extends slightly beyond the sides of ribs 48.

Figure 4:
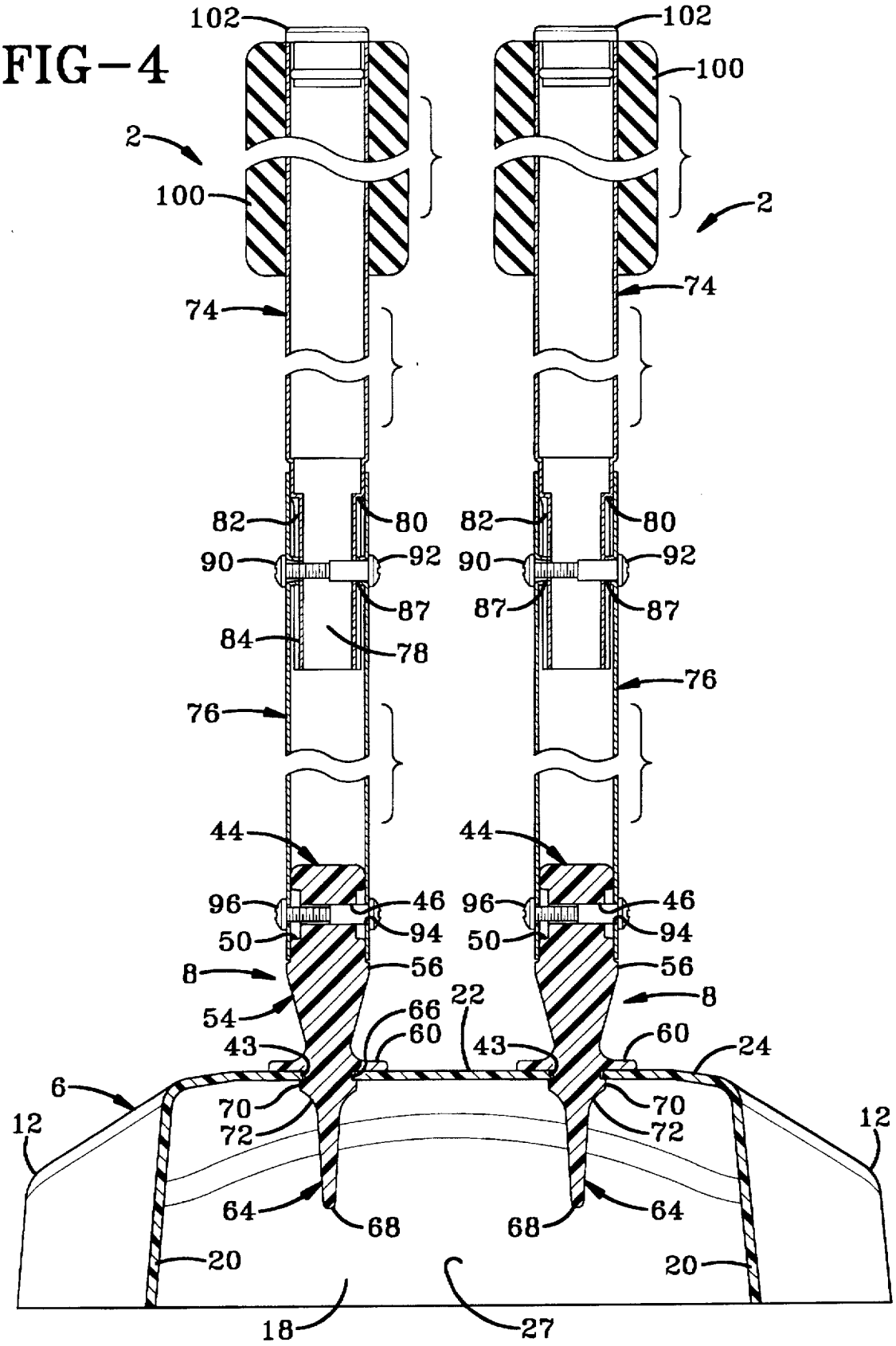
FIG. 4 is a sectional view of the lunge poles of FIG. 3.

Top section 44 is formed integrally with a middle section 54 which has a disc-shaped top portion 56 and a generally cone-shaped bottom portion 58. The bottom of middle section 54 is formed integrally with a relatively large circular or disc-shaped flange 60. An inwardly curved flexible neck 62 connects the bottom of cone-shaped portion 58 with the top surface of circular flange 60. A downwardly extending stem 64 is formed on the bottom surface of flange 60. Stem 64 has an annular groove 66 formed therein which allows couplings 8 to snap fit with base 6 as shown in FIG. 4. Stem 64 includes a tapered pointed end 68 which is connected to an upper cylindrical portion 70 of stem 64 by an inwardly curved neck 72. End 68 and upper portion 70 extend below top surface 24 of base 6 within hollow chamber 27.

Resilient couplings 8 preferably are formed of a polyvinyl chloride(PVC) compound designed for general purpose, extrusion and injection molding applications. The preferred PVC compound found best suited for forming couplings 8 has a shore "A" hardness of 75, a specific gravity of 1.40g/cm$^3$, a 100% modulus of 1170 psi, a tensile strength of 2650 psi and an ultimate longation of 365%. It is understood that the above described PVC compound is a preferred material and that other flexible elastomeric materials having similar functional characteristics may be used without affecting the concept of the invention.

In accordance with another of the features of the invention, poles 2 are generally tubular and include separate upper and lower sections 74 and 76, respectively (FIGS. 3 and 4). Upper and lower sections 74 and 76, respectively, preferably are formed of a thin wall aluminum. Upper section 74 of each pole 2 has a reduced diameter bottom portion 78 formed by an inward annular step 80. A pair of diametrically opposed recessed areas 82 having a flat inner wall 84 are formed in narrow portion 78. A pair of axially aligned holes 86 is formed in inner walls 84 each of which includes an inwardly extending annular support tab 87 (FIG. 4) which reinforces the perimeter edge of holes 86.

Narrow bottom portion 78 of upper section 74 extends within the open top end of lower section 76. A pair of axially aligned holes 88 are formed adjacent the top end of lower section 76 which align with holes 86 of upper section 74 when upper section 74 is attached to lower section 76. Poles 2 are assembled by inserting narrow portion 78 within lower section 76 until step 80 abuts the top end of lower section 76. A bolt 90 extends through holes 88 and 86 and is received within an internally threaded nut housing 92 to secure upper section 74 to lower section 76. Bolt 90 is tightened until support tabs 87 abut flat inner walls 84 of recessed areas 82.

The bottom end of lower section 76 extends over criss-cross-shaped top 44 of one of couplings 8. A pair of axially aligned opposed holes 94 is formed adjacent the bottom end of lower section 76 which aligns with hole 46 of coupling 8 when lower section 76 is attached thereto. A bolt 96 and internally threaded nut housing 98 extend through holes 94 and 46 to secure each pole 2 to its respective coupling 8.

A cylindrical-shaped foam handle 100 is disposed over the top end of each upper section 74 of poles 2 to provide a comfortable gripping location for a user to grasp poles 2 when using lunge poles 1. A plastic cap 102 is mounted within the top open end of upper section 74 to provide a smooth upper surface for poles 2 and to prevent a user from being injured on the relatively sharp ends thereof.

Figure 5:
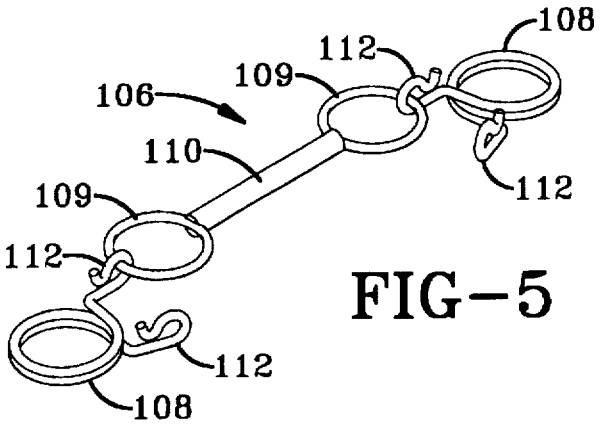
FIG. 5 is a perspective view of a removable resistance band.

In accordance with another feature of the invention, a flexible resilient band 106 (FIG. 5) is optionally and adjustably attachable to poles 2 to increase the resistance of the pivotal movement between the poles as shown in FIG. 1. Band 106 includes a pair of adjustable snap rings 108, a pair of middle rings 109 connected to snap rings 108 and a flexible resilient strap 110 extending between middle rings 109. Snap rings 108 are of a spring-type having a pair of spaced tabs 112 which when pinched towards one another increases the inner diameter of snap ring 108. Middle rings 109 extend through the center of one tab 112 of snap rings 108. Resistant bands 106 are removably attached to poles 2 as shown in FIG. 1 whereby strap 110 extends between the poles creating a resistance therebetween. Tabs 112 allow snap rings 108 to be moved vertically along poles 2 varying the resistance between the poles as described below.

In use, the user stands on a flat surface with his or her feet adjacent one another approximately shoulder width apart. Base 6 is placed in an approximate range of 1 to 3 feet in front of the user, depending upon the user's height, with one of ends 14 facing the user. The user grasps one foam handle 100 of poles 2 which align with the respective side of the user and places his or her arms to his or her sides in a slightly bent position. Poles 2 will extend angularly between base 6 and the user. The user then places his left foot, for example, forward adjacent the left side of base 6. The user simultaneously extends his or her left arm outwardly and resilient coupling 8 attached to the left pole 2 allows the pole to pivot forward. The user bends each of his or her knees while simultaneously squatting downward. The user's left leg will extend upwardly from the floor and is bent at a 90° angle and the user's right leg will extend forward from his or her foot substantially parallel to the floor then upwardly at a 90° angle. The user's right arm maintains right pole 2 in a relatively stationary position. When the user has reached the above described lunged position, the user raises upwardly straightening his or her legs and placing his or her left foot back to its original position adjacent the user's right foot.

The user then repeats the above described lunge placing his or her right foot forward adjacent a right side of base 6 while squatting and bending his or her knees pivoting right pole 2 forward relative to base 6. These lunges are continually repeated and allow a user to obtain an aerobic cardiovascular workout which exercises the user's hips, buttocks and thighs. Lunge poles 1, and particularly resilient couplings 8, assist the user in obtaining his or her balance while performing the lunges and allow the user to obtain an upper body workout by extending his or her arms pivoting poles 2 on base 6.

Resistance band 110 can be selectively attached to lunge poles 1 prior to connecting upper section 74 to lower section 76 of each pole 2. Tabs 1 12 are pinched toward one another increasing the diameter of snap ring 108 allowing snap ring 108 to slide vertically along poles 2. When resistance band 106 is placed in the desired position, tabs 112 are released allowing the spring action of snap rings 108 to tighten snap rings 108 around poles 2 retaining resistance band 106 in position. Resistance band 106 creates a tension between poles 2 allowing the user to increase his or her upper body workout when the respective pole is pivoted forward during lunges as described above. Resistance band 106 may be moved vertically along poles 2 increasing the resistance therebetween as the resistance band is moved closer to foam handles 100.

Necks 62 of resilient couplings 8 allow poles 2 to pivot or move in a 360° cone-like range and in numerous linear directions depending upon the particular exercise being performed. The tapering of cone-shaped bottom portion 58 allows for increased flexibility and pin-points the pivotal universal movement at neck 62 adjacent top surface 24 of base 6. Circular flange 60 prevents resilient couplings 8 from being pushed downwardly through holes 42 of base 6 and grooves 66 of couplings 8 prevent the couplings from popping of their snap-fit engagement with edge 43 of holes 42.

The two-piece construction of poles 2 allow lunge poles 1 to be packaged and shipped in a container of minimal size which reduces the shipping costs of lunge poles 1. Lunge poles 1 are easily assembled by snap-fitting couplings 8 to base 6 and bolting lower section 76 of poles 2 thereto. Upper section 74 of poles 2 are inserted into lower section 76 and bolted together with nut and bolt 92 and 90, respectively. The criss-cross configuration of top 44 of couplings 8 provide a snug engagement between poles 2 and couplings 8. Stem 64 reinforces the snap-fit engagement between couplings 8 and base 6 and helps prevent the couplings from popping out of holes 42 during use of lunge poles 1 by a user.

Again, the important feature of lunge poles 1 is the use of resilient couplings 8 which allow poles 2 to pivot or move in a 360° range of motion and which bias poles 2 back to their vertically extending position of FIG. I when poles 1 are not in use. Also, the compact size of lunge poles 1 during shipping, use and storage provides an inexpensive exercise device which allows a user to obtain an effective upper and lower body cardiovascular workout.

Accordingly, lunge poles 1 assist the user in maintaining his or her balance while performing lunges. Resilient couplings 8 mount poles 2 on base 6 and provide a universal-type joint which allows for 360° movement as well as linear movement. Additionally, rubber pads 32 retain lunge poles 1 in a stationary position on the floor while the user is performing lunges. Also, the two-piece design of poles 2, the easy assembly thereof and the snap-fit engagement of couplings 8 with base 6 allow lunge poles 1 to be shipped in a relatively small container to minimize the shipping size of poles 1 which, in turn, reduces the shipping cost. Furthermore, stem 64 of coupling 8 reinforces the snap-fit engagement with groove 66 to further prevent poles 2 from detaching from base 6 during use of lunge poles 1. Resistance band 106 provides a tension between poles 2 and is vertically adjustable to increase the resistance therebetween, allowing the user to selectively increase his or her upper body workout when performing lunges with lunge poles 1.

Accordingly, the improved lunge poles provide an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved lunge poles are constructed and used, the characteristics of the construction, and the advantageous, new and useful results obtained; the new and useful structures, devices, elements, arrangements, parts and combinations, are set forth in the appended claims.

I claim:

1. An exercise device including:

a base;

a first pole pivotally connected to the base;

a first flexible elastomeric coupling extending between the first pole and the base and having a top portion which connects to the first pole, a stem portion which connects to the base and a neck portion extending therebetween, said neck portion being flexible to provide the pivotal movement of the first pole with respect to the base;

a second pole pivotally connected to the base and independently movable relative to the first pole; and a second flexible elastomeric coupling extending between the second pole and the base and having a top portion which connects to the second pole, a stem portion which connects to the base and a neck portion extending therebetween, said neck portion being flexible to provide the pivotal movement of the second pole with respect to the base.

2. The exercise device defined in claim 1 further including a pair of holes formed in the base, said holes having an outer circular edge.

3. The exercise device defined in claim 2 in which an annular groove is formed in each of the first and second flexible elastomeric couplings.

4. The exercise device defined in claim 3 in which the outer circular edges of the holes extend within the annular grooves of the first and second flexible elastomeric couplings to snap-fit the first and second flexible elastomeric couplings to the base.

5. The exercise device defined in claim 1 in which the first and second flexible elastomeric couplings each include a relatively thin flexible neck portion which allows the first and second poles, respectively, to move in a 360 degree range of motion and in a linear direction.

6. The exercise device defined in claim 1 in which the elastomeric material used to form the first and second flexible elastomeric couplings is a polyvinyl chloride compound.

7. The exercise device defined in claim 6 in which the polyvinyl chloride compound has a shore "A" hardness of approximately 75.

8. The exercise device defined in claim 6 in which the polyvinyl chloride compound has a 100% modulus of elasticity approximately equal to 1170 psi.

9. The exercise device defined in claim 6 in which the polyvinyl chloride compound has a tensile strength of approximately 2650 psi.

10. The exercise device defined in claim 6 in which the polyvinyl chloride compound has an ultimate elongation of approximately 365%.

11. The exercise device defined in claim 6 in which the polyvinyl chloride compound has a specific gravity of approximately 1.40 g/cm$^3$.

12. The exercise device defined in claim 4 in which a disc-shaped flange is formed on each of the first and second elastomeric couplings to prevent the couplings from being forced through the holes.

13. The exercise device defined in claim 1 in which the first and second flexible elastomeric couplings each include a bottom stem portion which extends beneath a top surface of the base.

14. The exercise device defined in claim 1 in which the first and second poles are tubular.

15. The exercise device defined in claim 14 in which the first and second tubular poles are formed of a thin-wall aluminum.

16. The exercise device defined in claim 14 in which each of the first and second poles includes an upper section which attaches to a lower section.

17. The exercise device defined in claim 1 further including a pair of foam handles extending around a top portion of the first and second poles.

18. The exercise device defined in claim 1 further including a removable resilient band attachable between the first and second poles creating a tension between said first and second poles.

19. The exercise device defined in claim 18 in which the resilient band is formed of rubber.

20. The exercise device defined in claim 19 in which the resilient band is connected to the first and second poles by a spring clip.

21. The exercise device defined in claim 1 further including a plurality of rubber pads fastened to a bottom surface of the base.

22. An exercise device including:

a base formed with a pair of holes, each having an outer circular edge;

a first pole pivotally connected to the base;

a first flexible elastomeric coupling extending between the first pole and the base, said first flexible elastomeric coupling being formed with an annular groove, said outer circular edge of one of the holes of the base extending within the annular groove of the first elastomeric coupling to snap-fit said first elastomeric coupling to the base, and a disc-shaped flange formed on the first elastomeric coupling to prevent said first flexible elastomeric coupling from being forced through the one hole;

a second pole pivotally connected to the base and independently movable relative to the first pole; and a second flexible elastomeric coupling extending between the second pole and the base, said second flexible elastomeric coupling being formed with an annular groove, said outer circular edge of the other of the holes of the base extending within the annular groove of the first elastomeric coupling to snap-fit said first elastomeric coupling to the base, and a disc-shaped flange formed on the first elastomeric coupling to prevent said second flexible elastomeric coupling from being forced through the other of the holes.

23. An exercise device including:

a base;

a first pole pivotally connected to the base;

a first flexible elastomeric coupling extending between the first pole and the base;

a second pole pivotally connected to the base and independently movable relative to the first pole;

a second flexible elastomeric coupling extending between the second pole and the base; and a removable resilient band attachable between the first and second poles creating a tension between said first and second poles.

* * * * *